US011241126B2

(12) United States Patent
McConnell

(10) Patent No.: US 11,241,126 B2
(45) Date of Patent: Feb. 8, 2022

(54) PORTABLE POTTY SEAT

(71) Applicant: Thomas E. McConnell, Santa Ynez, CA (US)

(72) Inventor: Thomas E. McConnell, Santa Ynez, CA (US)

(73) Assignee: 1316 LLC, Las Vegas, NV (US)

( * ) Notice: Subject to any disclaimer, the term of this patent is extended or adjusted under 35 U.S.C. 154(b) by 0 days.

(21) Appl. No.: 17/017,699

(22) Filed: Sep. 11, 2020

(65) Prior Publication Data

US 2021/0145224 A1 May 20, 2021

(30) Foreign Application Priority Data

Nov. 18, 2019 (CN) ..... 201921983678.0

(51) Int. Cl.
*A47K 13/00* (2006.01)
*A47K 13/04* (2006.01)
(Continued)

(52) U.S. Cl.
CPC ..... *A47K 13/005* (2013.01); *A47K 13/04* (2013.01); *A47K 13/02* (2013.01); *A47K 13/06* (2013.01)

(58) Field of Classification Search
CPC ..... A47C 4/03; A47C 4/045; A47K 13/005; A47K 13/02; A47K 13/04; A47K 13/06; A47K 13/14; A47K 13/247; A47K 13/28
See application file for complete search history.

(56) References Cited

U.S. PATENT DOCUMENTS 1,410,427 A * 3/1922 Walter ..... A47K 13/06 4/239
5,005,223 A * 4/1991 Greenwood ..... A47K 13/06 4/235

(Continued)

FOREIGN PATENT DOCUMENTS

GB 619385 * 3/1949 ..... A47K 13/06

*Primary Examiner* — David P Angwin
*Assistant Examiner* — Nicholas A Ros
(74) *Attorney, Agent, or Firm* — WPAT Law, P.C.; Anthony King

(57) ABSTRACT

This disclosure relates to a portable potty seat for a toilet. This disclosure aims to provide a portable potty seat, which has the advantages of simple structure, light volume and can be adapted to toilets with different sizes and specifications. The portable potty seat of the disclosure includes: the body of the potty seat, the separation component, the front-end reinforcement and the rear end reinforcement; the body of the potty seat is an annular thin plate-shaped component integrally formed by flexible materials, the middle part is an opening corresponding to the toilet ring opening of a toilet seat, and the edge is provided with a locking component; the separation component covers the bottom of the potty seat body to strengthen the rigidity of the potty seat body, It will not affect the folding convenience, and the gap between the sheets of the separating components will naturally form a folding auxiliary line to facilitate the folding forming; the front end reinforcement and the rear end reinforcement respectively further strengthen the front end and the rear end of the portable toilet, so that the same portable potty seat can be applied to the toilet seats of different sizes and specifications.

13 Claims, 5 Drawing Sheets

(51) Int. Cl.
*A47K 13/02* (2006.01)
*A47K 13/06* (2006.01)

(56) References Cited

U.S. PATENT DOCUMENTS 6,175,968 B1 * 1/2001 Schneider ..... A47K 13/005 4/239
10,722,084 B2 * 7/2020 Evans ..... A47K 13/14

* cited by examiner

PORTABLE POTTY SEAT

CROSS-REFERENCE TO RELATED APPLICATIONS

This application claims priority to China Utility Model Patent Application No. 201921983678.0, filed on Nov. 18, 2019, which is hereby incorporated by reference in its entirety.

FIELD OF THE DISCLOSURE

The disclosure relates to the technical field of a toilet, in particular to a portable potty seat.

BACKGROUND OF THE DISCLOSURE

Many public restrooms are equipped with sitting toilets, or toilet bowls. Even if the cleaning personnel clean the public toilets timely to ensure the cleanliness of the toilets, but for most people, they will still worry about the insufficiency of cleaning and the existence of invisible bacteria; people still have concerns about using the toilet bowl in public places. Although some public restrooms will provide disposable paper toilet pad or disinfectant to facilitate users to use the toilet. However, such places are not widely used at present, and most public toilets still cannot provide disposable toilet seat pads or disinfectants or cannot be replenished in time. Moreover, the use of many paper toilet seat pads is not conducive to environmental protection. The use of disinfectant is usually accompanied using toilet paper as a carrier, which is also not conducive to environmental protection. Moreover, due to the soft material, it is not convenient to use the disposable paper toilet seat pad when the preset opening does not match the toilet opening size, or even cannot achieve the purpose of effectively covering the toilet seat.

In order to avoid the inconvenient use of unsuitable size and ensure that it can be safely placed on the toilet seat, the existing potty seats used for the toilets are made of hard materials, such as plastic, memory plastic, etc. However, this kind of potty seat is more suitable for fixed-point use in a fixed place and cannot be easily portable. For the convenience of carrying, some products are divided or folded into several smaller parts through the connection structure to reduce the overall volume. However, it is still inconvenient to carry. If the potty seat is made of lighter and softer materials, the hardness of the potty seat would not be enough to support itself. When the shape of the potty seat cannot fully fit the toilet seat of the toilet, the potty seat laid on the toilet seat is prone to collapse and cannot be used.

All referenced patents, applications and literatures are incorporated herein by reference in their entirety. Furthermore, where a definition or use of a term in a reference, which is incorporated by reference herein, is inconsistent or contrary to the definition of that term provided herein, the definition of that term provided herein applies and the definition of that term in the reference does not apply. The disclosed embodiments may seek to satisfy one or more of the above-mentioned needs. Although the present embodiments may obviate one or more of the above-mentioned needs, it should be understood that some aspects of the embodiments might not necessarily obviate them.

BRIEF SUMMARY OF THE DISCLOSURE

This disclosure aims to overcome the shortcomings of the prior art, and provides a portable potty seat with simple structure, light volume, and can adapt to the different sizes and specifications of the toilet seats.

One contemplated purpose of the disclosure is to achieve the following:

A portable potty seat, which is used to cover the toilet seat of a toilet bowl when sitting, and comprises a main body, a separation component, a front-end reinforcement and a rear-end reinforcement.

The main body of the potty seat is an annular thin plate shaped component integrally formed by flexible materials. The middle part of the main body of the potty seat is an opening corresponding to the opening of a toilet seat of a toilet bowl, and the edge of the main body of the toilet can be provided with a buckle component.

The main body is comprised of a first sheet, a second sheet, a third sheet and a fourth sheet, all of which are successively disposed on the bottom surface of the main body. There is a certain gap between two adjacent sheets; the first sheet and the second sheet are symmetrically disposed on the front half of the bottom surface of the main body and the gap between them forms the first longitudinal folding auxiliary line. The third sheet and the fourth sheet are symmetrically disposed on the back half of the bottom surface of the main body and the gap between them forms the second longitudinal folding auxiliary line. The first and second longitudinal folding guides are in the same line, or co-linear. The gap between the first sheet and the fourth sheet forms the first transverse folding auxiliary line, the gap between the second sheet and the third sheet forms the second transverse folding auxiliary line, and the first transverse folding auxiliary line and the second transverse folding auxiliary line are in the same straight line, or co-linear.

The shape of the front-end reinforcement can be matched with the shape of the front end of the main body. One end of the front end reinforcement can be rotatably fixed on the first sheet or second sheet by the first axis, the second sheet or first sheet is provided with a front end reinforcement fixing buckle, and the other end of the front end reinforcement is detachably fixed on the front end reinforcement fixing buckle by the first buckle hole. When the first axis is set on the first sheet, the front-end reinforcement fixing buckle is set on the second sheet, so that when the two ends of the front-end reinforcement are respectively connected with the first axis and the front-end reinforcement fixing buckle, the whole front-end reinforcement spans and covers the first longitudinal folding auxiliary line between the first sheet and the second sheet, realizing the front-end reinforcement of the main body. On the contrary, when the first axis is set on the second sheet, the front-end reinforcing fixing buckle is set on the first sheet. When the two ends of the front-end reinforcement are respectively fixed on the two sheets, the two edges of the front-end reinforcement are all within the bottom range of the main body.

The shape of the rear end reinforcement can be adapted to the shape of the rear end of the main body. The third sheet and the fourth sheet are provided with a rear-end reinforcing fixing buckle, and the two ends of the rear-end reinforcing member are detachably fixed on the rear-end reinforcing fixing buckle through the second buckle hole. A certain slot is arranged on the third sheet or the fourth sheet, and the side edge of one end of the rear end reinforcement is clamped in the positioning slot. When both ends of the rear-end reinforcement are fixed on the two sheets, the edges of both sides of the rear-end reinforcement are within the bottom range of the main body. When the opening size of the toilet ring of the does not match the opening size of the portable potty seat, the front end or the rear end of the portable potty seat can have a portion that is partially suspended in the air. At this time, the hardness of the front end or the rear end of the portable potty seat can be enhanced by the front-end reinforcement or the rear end reinforcement. As a result, and the shape of the main body can be maintained, and the portable potty seat can be used smoothly even when a portion of the main is suspended in the air.

When it needs to be folded up after use, separate the first buckle hole of the front-end reinforcement from the front-end reinforcement fixing buckle, and then rotate around the sheet where the first axis of the first axis of the first axis is located to be completely within the range of the sheet, remove the rear-end reinforcement from the third sheet and the fourth sheet and fold it over, and then buckle one end of the side in the positioning groove, so that the rear-end reinforcement is completely covered on the sheet where the positioning groove is located, the longitudinal folding auxiliary line is exposed, the portable potty seat is folded onto itself twice along the folding auxiliary lines, and is fastened by the locking member to complete the folding and securing without scattering, thereby ensuring convenient storage.

The potty seat disclosed herein has the following beneficial effects due to the adoption of the above technical scheme: the portable potty seat can be made of flexible materials, which is convenient to fold and light in weight, and can be stored and carried in a bag after folding; the bottom of the main body can have separation component sheets to strengthen the rigidity of the main body without affecting the folding convenience; the gap between the sheets naturally forms a folding auxiliary line to facilitate folding; the front end reinforcement and the rear end reinforcement further strengthen the front end and the rear end of the portable potty seat respectively, so that the same portable potty seat can be applied to the toilet seats of different sizes; for the toilet seats of the same size, the front end reinforcement and the rear The end stiffener can strengthen the front and rear rigidity of the portable potty seat. By forming a small area of dislocation with the toilet seat, the size of the opening of the potty seat can be slightly adjusted to be more suitable for children's sitting.

Preferably, the central axis of the first axis is perpendicular to the sheet surface provided with the first axis.

Preferably, the first axis and the positioning groove are respectively arranged on two sheets which are not adjacent, so that the front-end reinforcement and the rear-end reinforcement do not overlap during the first folding.

Wherein, the lock catch member is composed of two parts: a first lock member and a second lock member matched with each other.

Preferably, the first locking member and the second locking member are symmetrically arranged near the first transverse folding auxiliary line and the second transverse folding auxiliary line with the straight line of the longitudinal folding auxiliary line as the central axis; or the first locking member and the second locking member are symmetrically arranged near the first longitudinal folding auxiliary line and the second longitudinal folding auxiliary line with the transverse folding auxiliary line as the central axis line.

Further, the separation component can also provided with reinforcing ribs, including but not limited to: the first sheet is provided with reinforcing ribs; the second sheet is provided with reinforcing ribs; the third sheet is provided with reinforcing ribs; or the fourth sheet is provided with reinforcing ribs. The arrangement of the reinforcing ribs can further strengthen the overall strength of the portable toilet and is more conducive to stable use. And the reinforcing rib is independently designed to be disposed on the separation component, which will not affect the folding of the portable toilet.

Further, the front-end reinforcement can also be provided with at least one reinforcing rib.

Further, the rear end reinforcement can also be provided with at least one reinforcing rib.

Preferably, the surface of the front-end reinforcement is provided with an anti-skid member. When the front end of the portable toilet is in contact with the toilet ring of the toilet, the anti-skid part arranged on the surface of the front-end reinforcement can strengthen the friction between them and avoid sliding.

Preferably, the surface of the rear end reinforcement is provided with an anti-skid member. When the back end of the portable toilet is in contact with the toilet ring of the toilet, the anti-skid part arranged on the surface of the rear-end reinforcement can strengthen the friction between them and avoid sliding.

When the first sheet, the second sheet, the third sheet and the fourth sheet are disposed on the bottom surface of the main body, the gap between the adjacent sheets can naturally form a folding auxiliary line. In daily use, the portable toilet can be folded and unfolded without disassembling the separation component. Preferably, the sheets are separably disposed on the bottom surface of the main body. When necessary (for example, when the accessories of the portable potty seat need to be replaced in case of damage, or when the portable potty seat needs to be cleaned), the sheets can be removed from the bottom surface of the main body, and the cleaning will be more convenient and efficient. The detachable covering method can adopt any existing mature technology, such as the form of buckle or slot, the method of repeatedly disassembling and fixing by hook-and-loop connectors or other methods, and so on.

Preferably, the first longitudinal folding auxiliary line, the second longitudinal folding auxiliary line, the first transverse folding auxiliary line and the second transverse folding auxiliary line are formed dent lines, so as to better help folding when folded. Moreover, due to the existence of these formed dent lines, when the separation component is removed from the bottom surface of the main body, the main body without the sheets can also be conveniently folded up.

BRIEF DESCRIPTION OF THE DRAWINGS

Other advantages and features of the utility model are shown through the following embodiments of the utility model and the description of the attached drawings. The embodiments are given in the form of examples, but are not limited to the following, wherein.

DETAILED DESCRIPTION OF THE EMBODIMENTS

Figure 1:
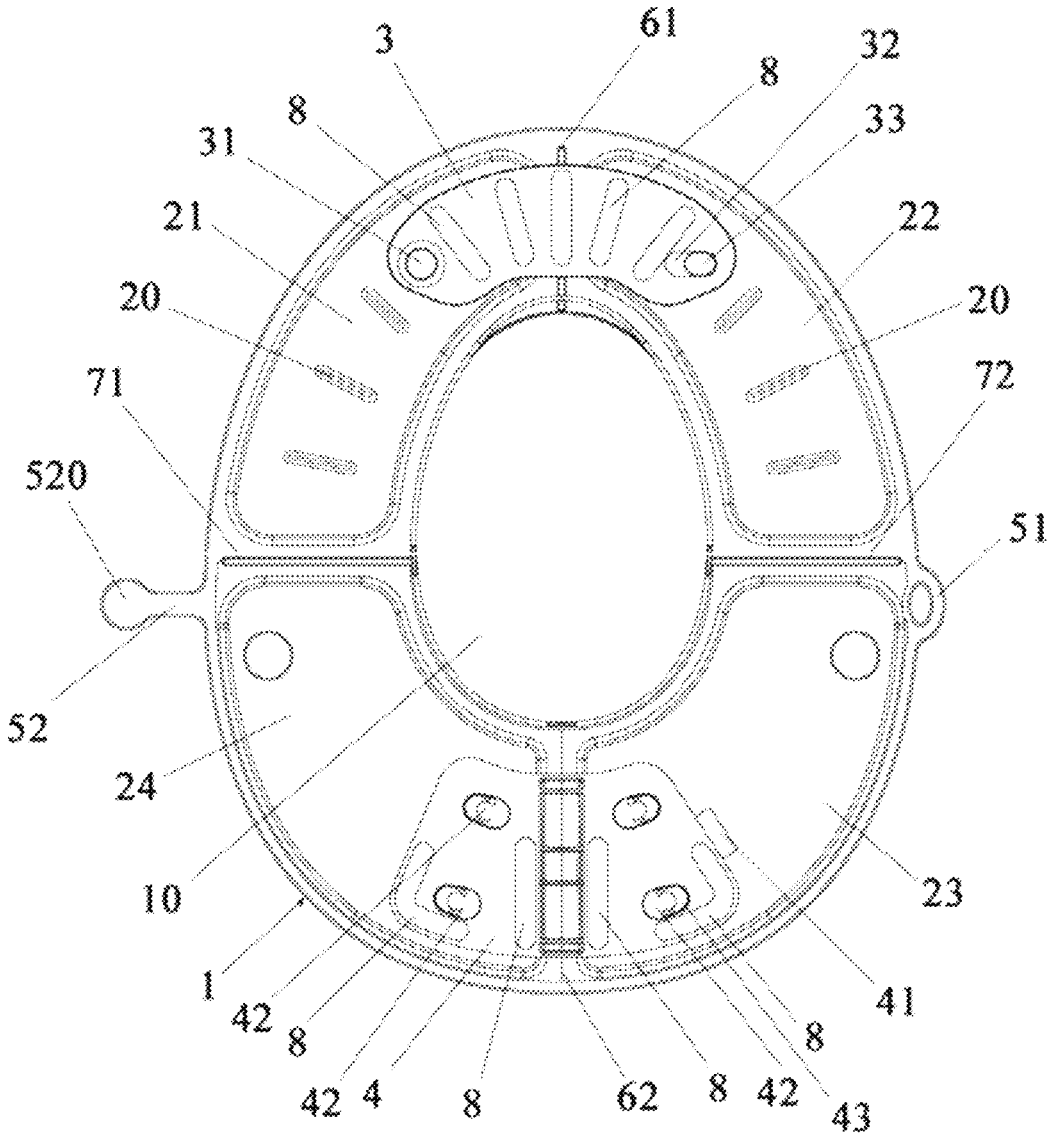
FIG. 1 is a bottom view of a preferred embodiment of the portable potty seat of the disclosure. At this time, the front-end reinforcement and the rear-end reinforcement are each disposed between two sheets and in a usable state.
Figure 2:
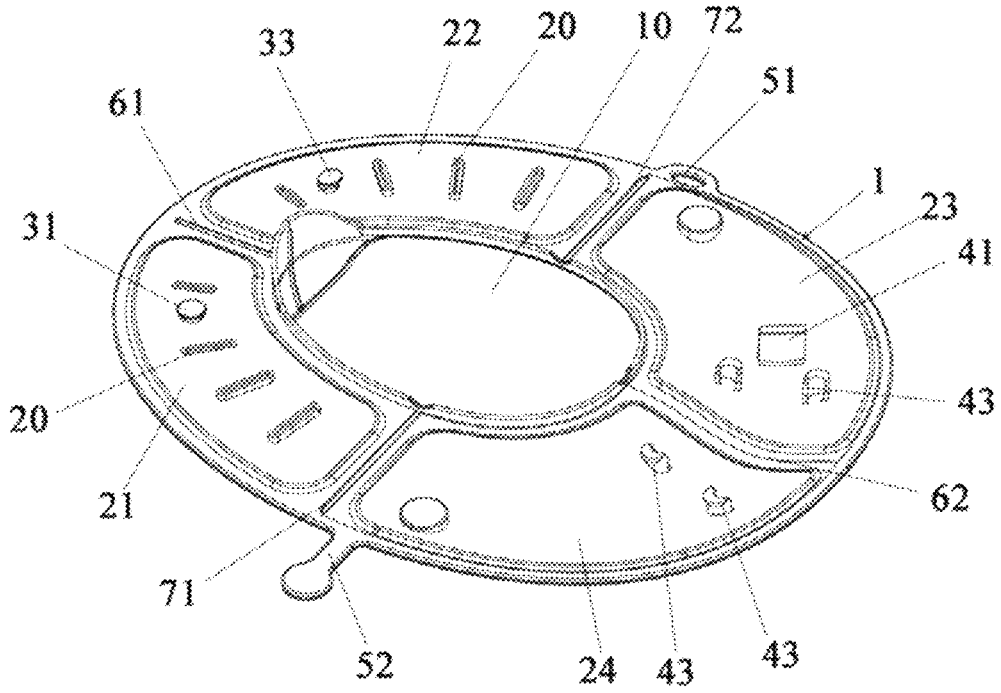
FIG. 2 is the structural diagram of the embodiment shown in FIG. 1, which only shows the main body of the toilet and the separation components, and the front-end reinforcement and the rear-end reinforcement are removed.
Figure 3:
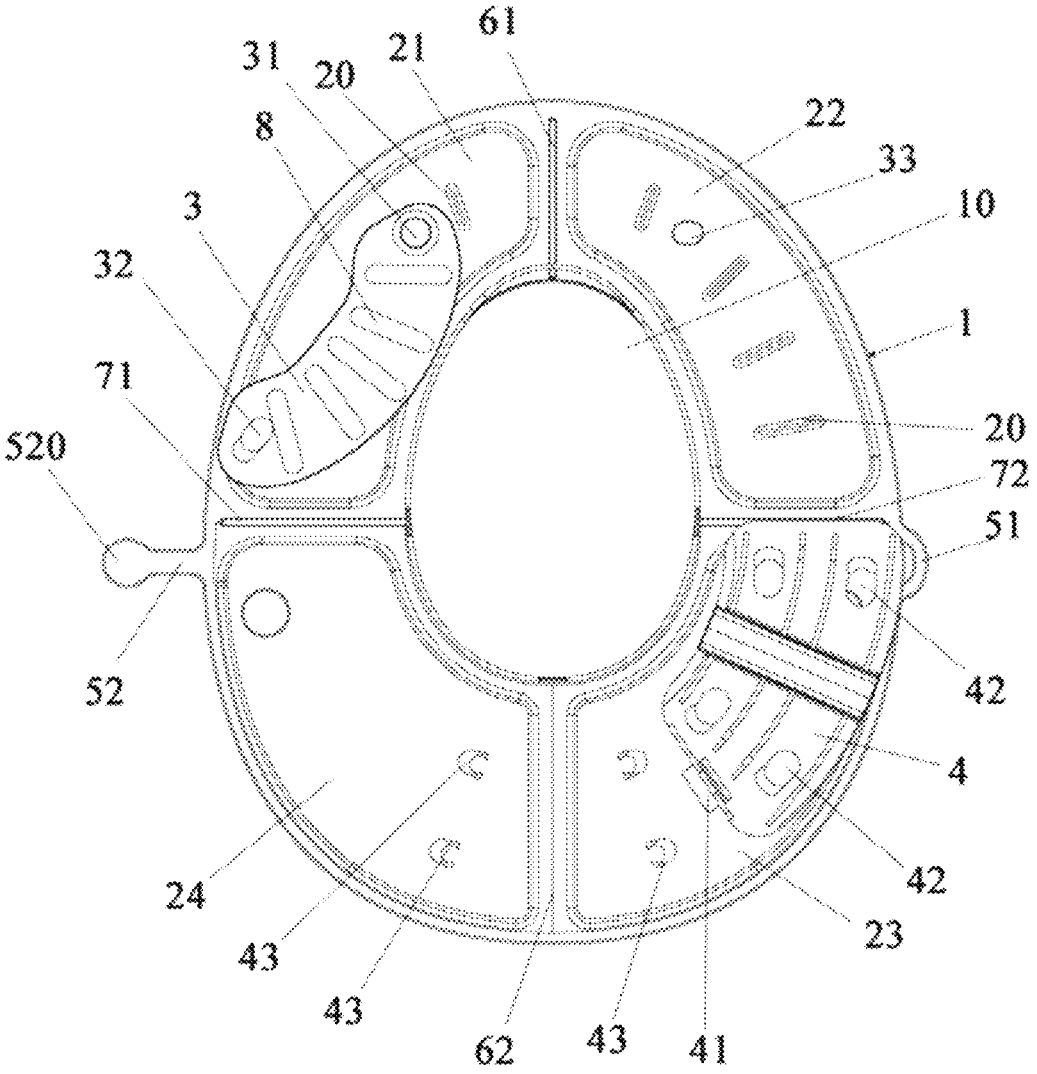
FIG. 3 is a structural diagram of the embodiment shown in FIG. 1, at this time, the front-end reinforcement and the rear-end reinforcement are in the stowed state, so as to enable folding up of the portable potty seat.
Figure 5:
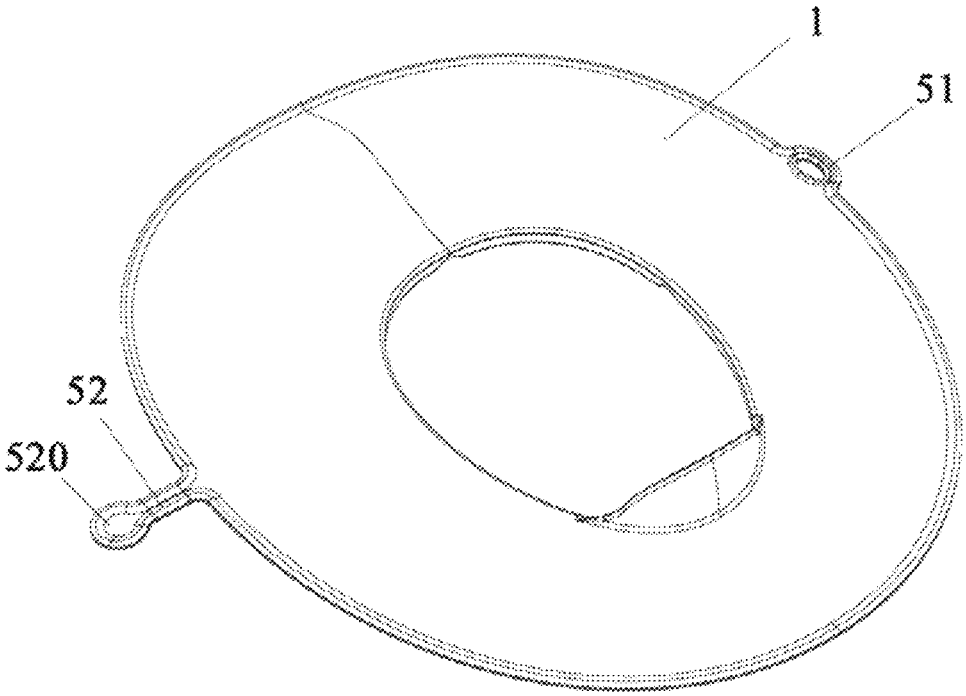
FIG. 5 is a schematic diagram of the embodiment shown in FIG. 1 when viewed from above. At this time, only the body of the toilet can be seen from the perspective of the figure.

The portable potty seat herein disclosed comprises a main body, a separation component, a front-end reinforcement and a rear-end reinforcement. As shown in FIG. 1-3, a preferred embodiment of the portable toilet of the utility model is that the main body 1 is an annular thin plate-shaped component integrally formed by a flexible material, the middle part is an opening 10 corresponding to the toilet seat opening of a toilet bowl, and the edge of the main body 1 is provided with a fixing ring 51 (i.e., the first locking member) and a tongue 52 (i.e., the second locking member), as shown in FIG. 5. A first longitudinal folding auxiliary line 61, a second longitudinal folding auxiliary line 62, a first transverse folding auxiliary line 71 and a second transverse folding auxiliary line 72 are respectively formed on the bottom middle longitudinal line and the middle transverse line of the main body 1 in the form of dent lines.

As shown in FIG. 2, the separation component is composed of the first sheet 21, the second sheet 22, the third sheet 23 and the fourth sheet 24 successively disposed on the bottom surface of the main body 1. The first sheet 21 and the second sheet 22 can be provided with reinforcing ribs 20. There is a certain gap between each two adjacent sheets, the first sheet 21 and the second sheet 22 are symmetrically covered on the front half of the bottom surface of the main body 1 and the gap between them forms the first longitudinal folding auxiliary line 61; the third sheet 23 and the fourth sheet 24 are symmetrically covered on the back half of the bottom surface of the main body 1 and the gap between them forms the second longitudinal folding auxiliary line 62. The gap between the first sheet 21 and the fourth sheet 24 forms a first transverse folding auxiliary line 71, and the gap between the second sheet 22 and the third sheet 23 forms a second transverse folding auxiliary line 72.

As shown in FIG. 1 and FIG. 3, one end of the front end reinforcement 3 is fixed on the first sheet 21 through the first axis 31 and can rotate around the central axis of the first axis 31, and the other end is provided with the first buckle hole 32. The second sheet 22 is provided with a front end reinforcing fixing buckle 33, and the central axis of the first axis 31 is perpendicular to a surface of the first sheet 21. When two ends of the front end reinforcement 3 are respectively connected with the first shaft 31 and the front end reinforcement fixing buckle 33, the whole front end reinforcement 3 spans and covers the first longitudinal folding auxiliary line 61 between the first sheet 21 and the second sheet 22. The shape of the front-end reinforcement 3 matches the shape of the front end of the main body 1. When the two ends of the front-end reinforcement 3 are respectively fixed on two sheets, the edges of both sides of the front-end reinforcement 3 are within the bottom range of the main body 1 and will not be exposed outside.

As shown in FIG. 1 and FIG. 3, both the third sheet 23 and the fourth sheet 24 are provided with rear-end reinforced fixing buckle 43. The two ends of the rear end reinforcement 4 are respectively detachably fixed on the third sheet 23 and the fourth sheet 24 through the second buckle hole 42 and the rear end reinforcement fixing buckle 43. The third sheet 23 is also provided with a positioning groove 41, and the side edge of one end of the rear end reinforcement is clamped in the positioning groove 41. At this time, the entire rear end reinforcement 4 spans and covers the second longitudinal folding auxiliary line 62 between the third sheet 23 and the fourth sheet 24. The shape of the rear end reinforcement 4 matches the shape of the rear end of the main body 1. When the two ends of the rear end reinforcement 4 are respectively fixed on two sheets, the edges of both sides of the rear end reinforcement 4 are located in the bottom range of the main body 1 and will not be exposed outside.

Preferably, the front-end reinforcement 3 and the rear-end reinforcement 4 are provided with anti-slip strips 8.

Figure 4:
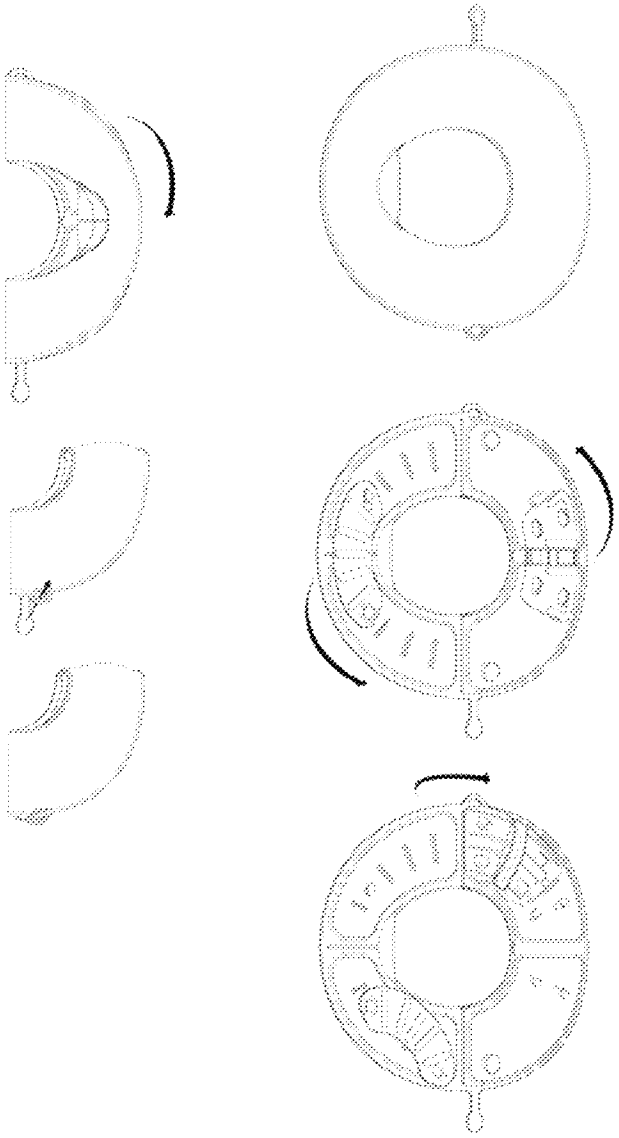
FIG. 4 is a breakdown diagram of the folding step of the embodiment shown in FIG. 1.

The folding and storage process is shown in FIG. 4. When it is necessary to fold up the portable potty seat, separate the first buckle hole 32 of the front-end reinforcement 3 from the front-end reinforcement fixing buckle 33, and then rotate it around the first axis 31 to the first sheet 21 until it is completely within the range of the first sheet 21; remove the rear-end reinforcement 4 from the third sheet 23 and the fourth sheet 24 and fold it over, and then buckle one end of the side clip in the positioning slot 41 Inside, the rear end reinforcement 4 is covered on the third sheet 23 as a whole, and the structure at this time is shown in FIG. 3. Fold the potty seat along the folding auxiliary line twice, then insert the tongue 52 into the fixing ring 51 and make a loose knot to prevent the tongue 52 from sliding out. In this embodiment, the end part of the tongue 52 is designed to have a convex part 520, which can prevent the tongue 52 from sliding out.

When it is necessary to use, the convex part 520 can be pulled out by applying a little force, and the folding portable toilet can be undone. In contrast to the above operations, the front-end reinforcement 3 is rotated around the first axis 31 to the second sheet 22, and then the first buckle hole 32 is buckled on the front-end reinforcement fixing buckle 33; the rear-end reinforcement 4 is turned over and fixed on the third sheet 23 and the fourth sheet through the second buckle hole 42 and the rear-end reinforcement fixing buckle 43 One end of the side edge of the material 24 is clamped in the positioning groove 41 to avoid falling off. The fully expanded portable potty seat can be used by covering the toilet seat of a toilet bowl.

In this embodiment, the fixing ring 51 and the tongue 52 are symmetrically arranged near the first transverse folding auxiliary line 71 and the second transverse folding auxiliary line 72 with the straight line of the longitudinal folding auxiliary line as the central axis. If the fixing ring 51 and the inserting tongue 52 take the straight line where the transverse folding auxiliary line is located as the central axis, it is also possible to symmetrically set them near the first longitudinal folding auxiliary line 61 and the second longitudinal folding auxiliary line 62, except that the folding sequence may be slightly changed during folding correspondingly.

Although the portable potty seat has been described above in accordance with preferred embodiments, this does not mean that the scope of the invention is only limited to the above structure. As long as the technical personnel in the field can easily develop an equivalent alternative structure after reading the above description, the equal changes and modifications made without departing from the spirit and scope of the utility model shall be covered within the scope of the patent.

What is claimed is:

1. A foldable portable potty seat to cover a toilet seat of a toilet, the portable potty seat comprising:

a main body;

a separation component disposed on the main body;

a front-end reinforcement rotatably attached to said separation component;

a rear-end reinforcement pivotally attached to said separation component;

an opening disposed in a middle of the main body to correspond to an opening of a toilet seat on top of which the potty seat can be placed;

wherein the main body has an annular thin plate shaped component and is integrally formed by a flexible material; and wherein the separation component includes a first sheet, a second sheet, a third sheet, and a fourth sheet successively disposed on a bottom surface of the main body with a gap in between two adjacent sheets of said first sheet, second sheet, third sheet, and fourth sheet;

wherein the first sheet and the second sheet are symmetrically disposed on a front half of the bottom side of the main body, and the gap between the first sheet and the second sheet forms a first longitudinal folding auxiliary line, wherein the third sheet and the fourth sheet are disposed on a back half of the bottom side of the main body and the gap between said third sheet and fourth sheet forms a second longitudinal folding auxiliary line;

wherein the first longitudinal folding auxiliary line and the second longitudinal folding auxiliary line are co-linear, and the gap between the first sheet and the fourth sheet forms a first transverse folding auxiliary line, and the gap between the second sheet and the third sheet forms a second transverse folding auxiliary line, the first transverse folding auxiliary line and the second transverse folding auxiliary line are co-linear.

2. The potty seat as recited in claim 1, wherein the front-end reinforcement has a shape that correlates with a shape of a front end of the main body, and a first end of the front-end reinforcement is rotatably fixed on the first sheet at a first axis.

3. The potty seat as recited in claim 1 further comprising reinforcing ribs disposed on at least one of said first sheet, second sheet, third sheet, fourth sheet, front-end reinforcement, and rear-end reinforcement.

4. The potty seat as recited in claim 1 further comprising an anti-slip member disposed on at least one of the front-end reinforcement and rear-end reinforcement.

5. The potty seat as recited in claim 1, wherein each of said first sheet, second sheet, third sheet, and fourth sheet is detachably attached to the bottom surface of the main body.

6. The potty seat as recited in claim 1, wherein each of said first and second longitudinal folding auxiliary lines, first and second transverse folding auxiliary lines is a formed dent line.

7. The potty seat as recited in claim 1 further comprising a first locking member and a second locking member, wherein the first and second locking members corresponds to each other.

8. The potty seat as recited in claim 7, wherein the first locking member and the second locking member are symmetrically and respectively disposed near the first transverse folding auxiliary line and the second transverse folding auxiliary line.

9. The potty seat as recited in claim 1 further comprising a front-end reinforcement fixing buckle, and a second end of the front-end reinforcement has a first buckle hole capable of being detachably fixed to the front-end reinforcement fixing buckle, thereby strengthening and fixing the first sheet and the second sheet into a non-foldable configuration.

10. The potty seat as recited in claim 9, wherein the first axis is a longitudinal axis perpendicular to a plane of the first sheet.

11. The potty seat as recited in claim 9 further comprising a rear-end reinforcement fixing buckle, and the rear-end reinforcement has a second buckle hole capable of being detachably fixed to the rear-end reinforcement fixing buckle, thereby strengthening and fixing the third sheet and the fourth sheet into a non-foldable configuration.

12. The potty seat as recited in claim 11 further comprising a positioning groove on either the third sheet or the fourth sheet, wherein the positioning groove receives an end of the rear-end reinforcement.

13. The potty seat as recited in claim 12, wherein the first axis and the positioning groove are respectively disposed on two of said first sheet, second sheet, third sheet, and fourth sheet that are non-adjacent.

* * * * *